US007468585B2

(12) United States Patent
Utsubo et al.

(10) Patent No.: US 7,468,585 B2
(45) Date of Patent: Dec. 23, 2008

(54) METAL HALIDE LAMP

(75) Inventors: Atsushi Utsubo, Toyonaka (JP); Hiroshi Nohara, Nishinomiya (JP); Yukiya Kanazawa, Osaka (JP); Yoshiharu Nishiura, Otsu (JP); Kiyoshi Takahashi, Kyotanabe (JP); Makoto Kai, Katano (JP); Makoto Horiuchi, Sakurai (JP)

(73) Assignee: Panasonic Corporation, Kadoma (JP)

( * ) Notice: Subject to any disclaimer, the term of this patent is extended or adjusted under 35 U.S.C. 154(b) by 580 days.

(21) Appl. No.: 10/547,060

(22) PCT Filed: Jul. 22, 2004

(86) PCT No.: PCT/JP2004/010789

§ 371 (c)(1),
(2), (4) Date: Aug. 26, 2005

(87) PCT Pub. No.: WO2005/010921

PCT Pub. Date: Feb. 3, 2005

(65) Prior Publication Data

US 2006/0170363 A1 Aug. 3, 2006

(30) Foreign Application Priority Data

Jul. 25, 2003 (JP) ..... 2003-279803

(51) Int. Cl.
*H01J 17/20* (2006.01)
*H01J 61/18* (2006.01)
*H01J 61/20* (2006.01)

(52) U.S. Cl. ..... 313/638; 313/637; 313/640; 313/641; 313/642; 313/643

(58) Field of Classification Search ..... 313/637–643
See application file for complete search history.

(56) References Cited

U.S. PATENT DOCUMENTS

| | | | | |
|---|---|---|---|---|
| 4,801,846 | A * | 1/1989 | Kramer et al. | 313/641 |
| 6,166,491 | A * | 12/2000 | Tsuchiya et al. | 315/169.3 |
| 2003/0025453 | A1 | 2/2003 | Kakisaka et al. | |
| 2003/0062831 | A1 * | 4/2003 | Alderman et al. | 313/567 |
| 2003/0102808 | A1 | 6/2003 | Dakin et al. | |
| 2004/0183472 | A1 * | 9/2004 | Kamoi et al. | 315/291 |
| 2004/0189212 | A1 * | 9/2004 | Ashida et al. | 315/97 |

FOREIGN PATENT DOCUMENTS

JP 2000-511689 9/2000

(Continued)

OTHER PUBLICATIONS

International Search Report for corresponding PCT/JP2004/010789, mailed Nov. 9, 2004.

*Primary Examiner*—Toan Ton
*Assistant Examiner*—Bumsuk Won
(74) *Attorney, Agent, or Firm*—Renner, Otto, Boisselle & Sklar, LLP

(57) ABSTRACT

A metal halide lamp of the present invention has an arc tube formed of ceramic and a pair of opposing electrodes. This lamp includes a Pr (praseodymium) halide, a Na (sodium) halide, and a Ca (calcium) halide enclosed within the arc tube. The Pr halide content Hp [mol], the Na halide content Hn [mol], and the Ca halide content Hc [mol] satisfy the relationships of $0.4 \leqq Hc/Hp \leqq 15.0$ and $3.0 \leqq Hn/Hp \leqq 25.0$.

15 Claims, 7 Drawing Sheets

FOREIGN PATENT DOCUMENTS

| | | |
|---|---|---|
| JP | 2003-086131 A | 3/2003 |
| JP | 2003-187744 | 7/2003 |
| WO | 98/25294 | 6/1998 |
| WO | 98/45872 | 10/1998 |
| WO | 00/45419 | 8/2000 |

* cited by examiner

METAL HALIDE LAMP

TECHNICAL FIELD

The present invention relates to a metal halide lamp for outdoor use or for use with a high ceiling or the like.

BACKGROUND ART

In recent years, vigorous development activities have been directed to ceramic metal halide lamps, which are metal halide lamps that employ ceramics as an arc tube material. A ceramic arc tube has advantages in that it allows little reaction with the emission material and provides excellent heat resistance, as compared to a quartz arc tube.

By utilizing the above advantages, it is possible to realize a metal halide lamp which is capable of operating at a higher temperature and provides a higher efficiency and higher color rendition than is possible with quartz.

An example of a metal halide lamp employing a ceramic arc tube is a lamp disclosed in Japanese National Phase PCT Laid-Open Publication No. 2000-511689. This lamp is a metal halide lamp whose ceramic arc tube has enclosed therein not only a halide of at least one of Na (sodium), Tl (thallium), Dy (dysprosium), and Ho (holmium), but also $CaI_2$ (calcium iodide), such that high color rendition with a general color rendering index Ra of 90 or more, as well as white light with a correlated color temperature from 3900K to 4200K, are provided.

However, the metal halide lamp described in Japanese National Phase PCT Laid-Open Publication No. 2000-511689 has an efficiency of about 85 LPW to 90 LPW in the case where the lamp has a power rating (lamp power rating) of 150 W (Watt); thus, it provides a higher efficiency than in the case of employing a quartz tube. Herein, "LPW" is an acronym of "Lumen Per Watt", with a unit of "lm/W".

In recent years, from the standpoint of energy saving, there has been a desire for light sources which have a higher efficiency than that of conventional metal halide lamps. While a high-pressure sodium lamp has a very efficiency of about 110 LPW (given a power rating of 180 W), it has a Ra of about 25, indicative of poor color rendition. Therefore, high-pressure sodium lamps are not likely to be used for stores or for high ceilings and the like, but are used for streetlights and the like.

Thus, not only a good lamp efficiency but also high color rendition is vital to illuminations for stores and high ceilings. In general, however, attempts to enhance the efficiency of a light source will result in an increased emission in the green range, for which there exists a strong luminous efficiency, and therefore invite a deterioration of color rendition. In other words, it is supposed to be very difficult to reconcile high efficiency with high color rendition.

The present invention has been made in view of the above problems, and aims to provide a metal halide lamp that exhibits an efficiency (100 LPW or more) which is at least 10% higher than the efficiency (typically 90 LPW) of conventional metal halide lamps, while maintaining high color rendition with a general color rendering index Ra of 70 or more, and preferably 85 or more. A 10% efficiency improvement (increase in luminous flux) is a marginal level for allowing humans to perceive some increase in brightness. The stipulation as to a general color rendering index Ra of 70 or more is believed to ensure high color rendition for enabling distinction of colors of objects in a general working situation at a factory or the like.

DISCLOSURE OF INVENTION

A metal halide lamp of the present invention is a metal halide lamp having an arc tube formed of ceramic and a pair of opposing electrodes, comprising: a Pr (praseodymium) halide, a Na (sodium) halide, and a Ca (calcium) halide enclosed within the arc tube, wherein the Pr halide content Hp [mol], the Na halide content Hn [mol], and the Ca halide content Hc [mol] satisfy the relationships of: $0.4 \leqq Hc/Hp \leqq 15.0$; and $3.0 \leqq Hn/Hp \leqq 25.0$.

In a preferred embodiment, each of the Pr halide content, the Na halide content, and the Ca halide content is equal to or greater than 1.0 $mg/cm^3$.

In a preferred embodiment, $0.4 \leqq Hc/Hp \leqq 4.7$.

In a preferred embodiment, $11.9 \leqq Hc/Hp \leqq 15$.

In a preferred embodiment, an inner diameter D(mm) of the arc tube and a distance L(mm) between tips of the electrodes satisfy the relationship $4 \leqq L/D \leqq 9$.

In a preferred embodiment, an outer tube for accommodating the arc tube is comprised, wherein an interspace between the arc tube and the outer tube is retained in a decompressed state at 1 kPa or less.

In a preferred embodiment, the general color rendering index Ra is 70 or more, and the lamp efficiency is 100 LPW or more.

An illumination device of the present invention comprises: any of the aforementioned metal halide lamps; and a means for performing dimming of the metal halide lamp.

In a preferred embodiment, the means includes an electronic ballast for supplying power to the electrodes of the metal halide lamp, and the electronic ballast is capable of regulating the power within a range from 25% of a rating to the rating.

BEST MODE FOR CARRYING OUT THE INVENTION

A metal halide lamp of the present invention includes a Pr (praseodymium) halide, a Na (sodium) halide, and a Ca (calcium) halide enclosed within an arc tube, such that the following relationships simultaneously exist between the Pr halide content Hp [mol], the Na halide content Hn [mol], and the Ca halide content Hc [mol]:

$$3.0 \leqq Hn/Hp \leqq 25.0 \quad \text{(eq. 1); and}$$

$$0.4 \leqq Hc/Hp \leqq 15.0 \quad \text{(eq. 2).}$$

A main characteristic feature of the present invention is that a Pr halide, a Na halide, and a Ca halide are enclosed in a ceramic arc tube at a ratio satisfying eq. 1 and eq. 2 above. The specific effects emanating therefrom will be described in conjunction with the description of the function and effects of below-described Examples.

Hereinafter, preferred embodiments of the metal halide lamp of the present invention will be described with reference to the figures.

Figure 1:
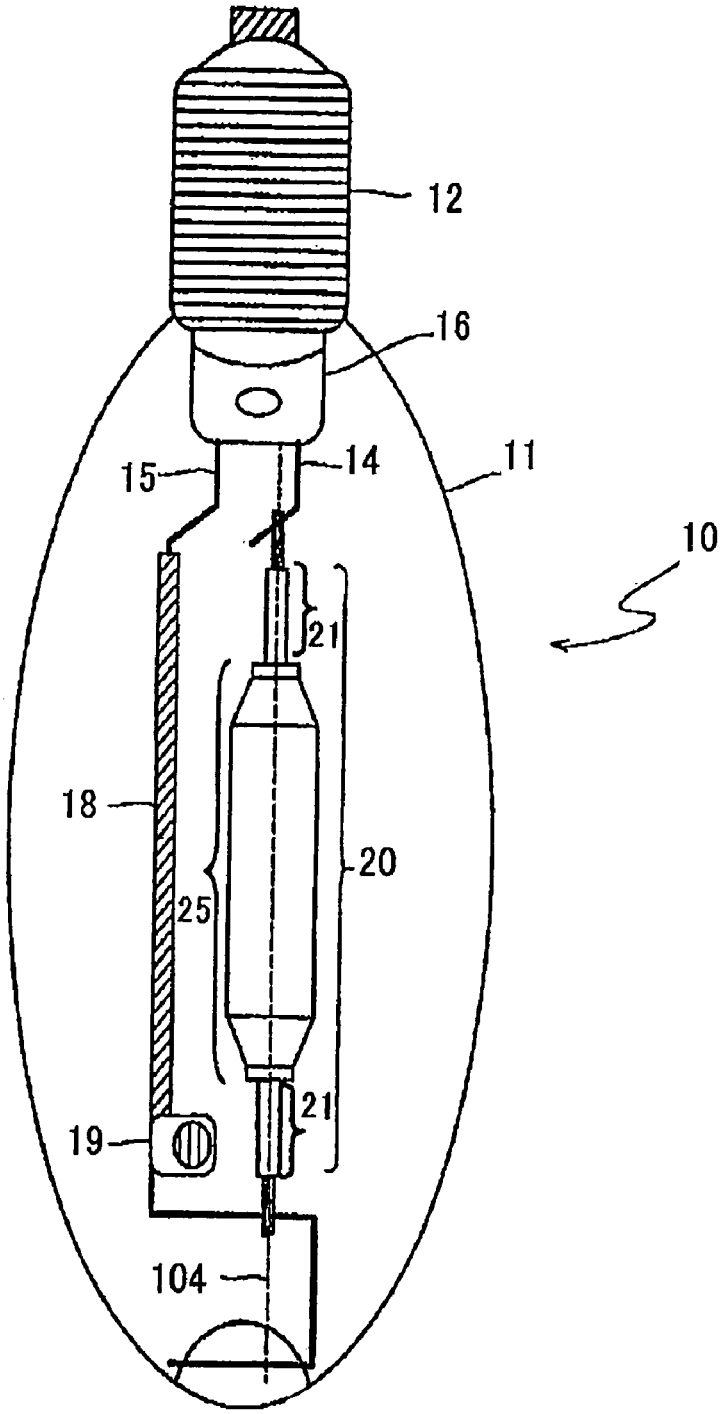
FIG. 1 is a side view of an arc discharge metal halide lamp of the present invention, internalizing a ceramic arc tube structure.

First, FIG. 1 is referred to. FIG. 1 is a diagram showing the structure of a metal halide lamp 10 of the present embodiment. This figure shows a spherical borosilicate outer tube 11 being fitted in an Edison-type metal base 12.

The metal halide lamp 10 of the present embodiment includes the transparent outer tube 11 and a ceramic arc tube 20 which is accommodated within the outer tube 11.

To the base 12, a borosilicate glass flare ("flare through the outer tube longitudinal axis") 16 is attached, which extends into the interior of the outer tube 11 along an axis in the longitudinal axis direction of the outer tube 11 (dotted line 104 in FIG. 1).

On the inside of the base 12, an electrically-insulated pair of electrode metal portions (not shown) are provided. From the respective electrode metal portions, lead-in electrode wires 14 and 15 (access wires) extend in parallel within the outer tube 11, through the borosilicate glass flare ("flare through the outer tube longitudinal axis") 16. The wires 14 and 15 are formed of, for example, nickel or mild steel.

A portion of the wire 15 which lies parallel to the outer tube longitudinal axis 104 extends inside the aluminum oxide ceramic tube 18 so that photoelectrons will not be generated from the surface of the wire 15 during lamp operation. Moreover, the portion of the wire 15 which lies parallel to the outer tube longitudinal axis 104 supports a getter 19 for capturing (adsorbing) gaseous impurities.

The ceramic arc tube 20 may take a variety of structures, as described later. The arc tube 20 structure shown in FIG. 1 is only exemplary. The arc tube 20 shown has a shell structure with polycrystalline alumina walls which are translucent with respect to visible light.

The arc tube 20 includes a main tubing 25 and a pair of small inner diameter/out diameter ceramic truncated cylindrical shell portions 21 (which may be referred to as "tubings 21"). The tubings 21 are sinter-fitted onto the two respective open ends of the main tubing 25.

The arc tube 20 is suitably formed from materials such as yttrium-aluminum-garnet (so-called YAG), aluminum nitride, alumina, yettria, and zirconia.

Figure 2:
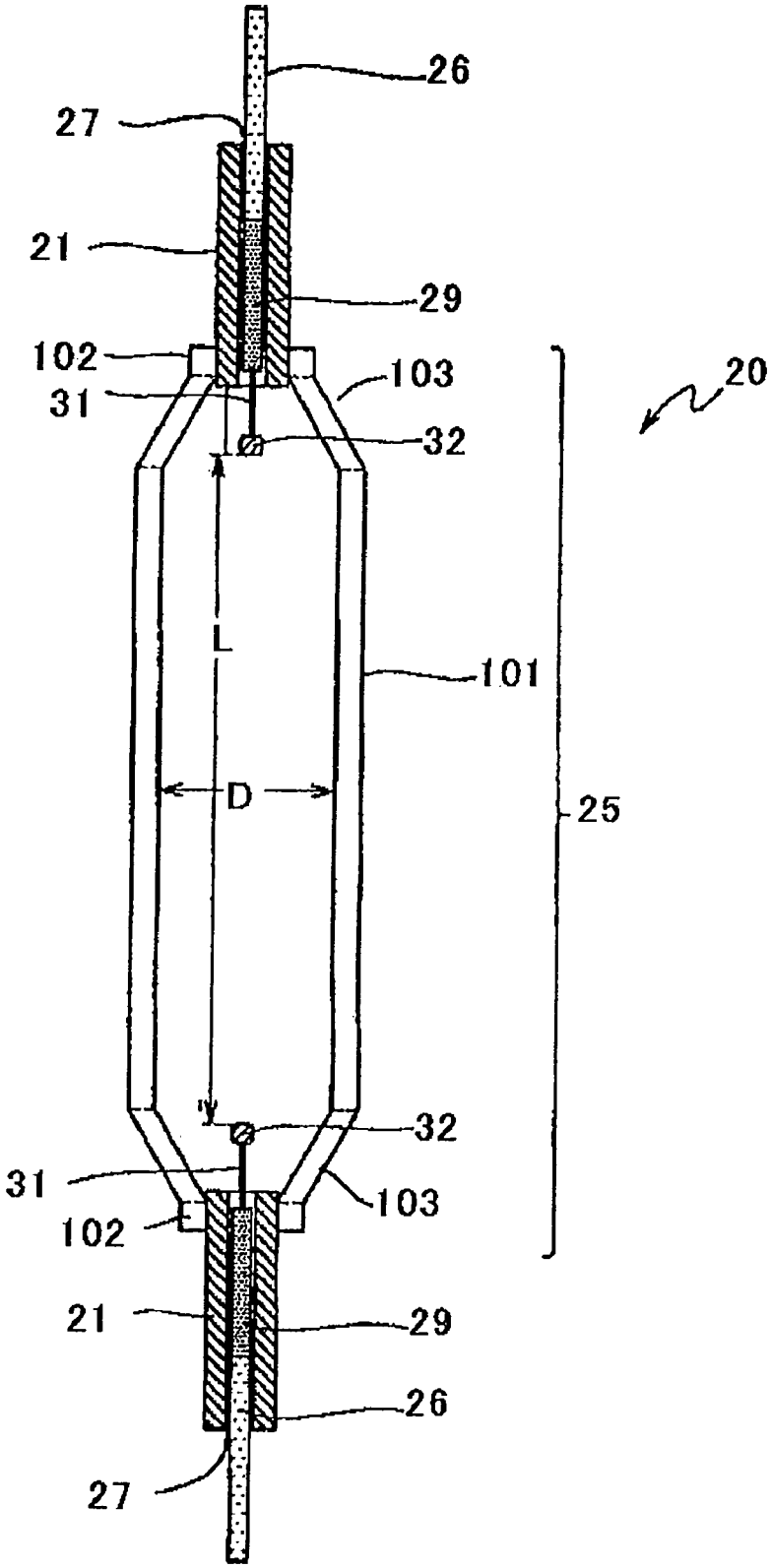
FIG. 2 is an enlarged cross-sectional view of the arc tube 20 of FIG. 1.

Next, referring to FIG. 2, the structure of the arc tube 20 will be specifically described. FIG. 2 is an enlarged cross-sectional view of the arc tube 20 of FIG. 1.

The main tubing 25 of the arc tube 20 shown in FIG. 2 includes: a shell portion 101 having an inner diameter D; a pair of cylindrical shell portions 102 connected to the respective tubings 21; and a pair of conical shell portions 103 connecting the shell portion 101 to the respective cylindrical shell portions 102.

From each tubing 21, a lead 26 of, e.g., niobium, extends outward from the tubing 21. The two leads 26 are respectively electrically connected to the wires 14 and 15 shown in FIG. 1, and are used as wiring for supplying lamp power.

One of the two leads 26 is welded to the wire 14 at a position where the wire 14 intersects the outer tube longitudinal axis 104 as shown in FIG. 1. The other of the two leads 26 is welded to the wire 15 at a position where the wire 15 intersects the outer tube longitudinal axis 104 as shown in FIG. 1. Thus, the arc tube 20 is disposed between the welded portions of the wire 14 and the wire 15, and is supported so that the longitudinal axis of the arc tube 20 substantially coincides with the outer tube longitudinal axis 104. As a result, input power which is necessary for lamp operation is supplied to the leads 26 of the arc tube 20 via the wires 14 and 15.

The leads 26 are affixed to the inner surface of the tubings 21 by means of glass frit 27, and thus sealed. Therefore, it is preferable that the thermal expansion characteristics (coefficient of linear expansion) of the leads 26 are close to the thermal expansion characteristics (coefficient of linear expansion) of the tubings 21 and the glass frit 27.

Inside each tubing 21 is placed a molybdenum lead-in wire 29. One end of the wire 29 is welded to one end of the lead 26, whereas the other end is welded to one end of a tungsten main electrode shaft 31. At the other end (tip portion) of the main electrode shaft 31 is provided an electrode 32 composed of a tungsten coil, which is welded integrally with the main electrode 31.

The leads 26 have a diameter of, e.g., 0.9 mm. The main electrode shafts 31 have a diameter of, e.g., 0.5 mm. These dimensions may be changed to suitable sizes depending on the purpose.

A particularly important parameter among the parameters defining the structure of the lamp of the present embodiment is a ratio L/D, which is defined by a length or distance "L (inter-electrode distance)" between the two electrodes 32 of the arc tube 20 and an inner diameter "D" of a portion of the main tubing 25 interposed between the electrodes.

In the present embodiment, the inter-electrode distance L is to be measured along a line (hereinafter referred to as a "inter-electrode line") connecting the centers of the tip portions of the pair of electrodes 32. On the other hand, the inner diameter D of the main tubing 25 is to be measured along a "plane" which lies substantially perpendicular to the inter-electrode line. In the present specification, "substantially perpendicular" disposition not only encompasses the case where the "inter-electrode line" lies exactly perpendicular to the aforementioned "plane", but also encompasses the case where the "plane" and the "inter-electrode line" intersect each other with an angle which slightly deviates from the right angle. Specifically, if the shape of the main tubing 25 and/or the positions of the electrodes 32 inside the main tubing 25 vary from those shown in FIG. 2, the plane defining the inner diameter (a plane perpendicular to the inner wall surface of the main tubing 25) and the inter-electrode line may no longer be of a "perpendicular" relationship. However, any such situation where the plane defining the inner diameter D and the inter-electrode line are not exactly perpendicular to each other should be tolerated as long as the associated decrease in emission characteristics is not problematic in terms of usual lamp design.

As described later, L/D is a commonplace parameter which affects the amount of light radiated from the arc tube 20, distribution of the excited state of active material atoms, expanse of the material emission line, and the like.

Figure 6:
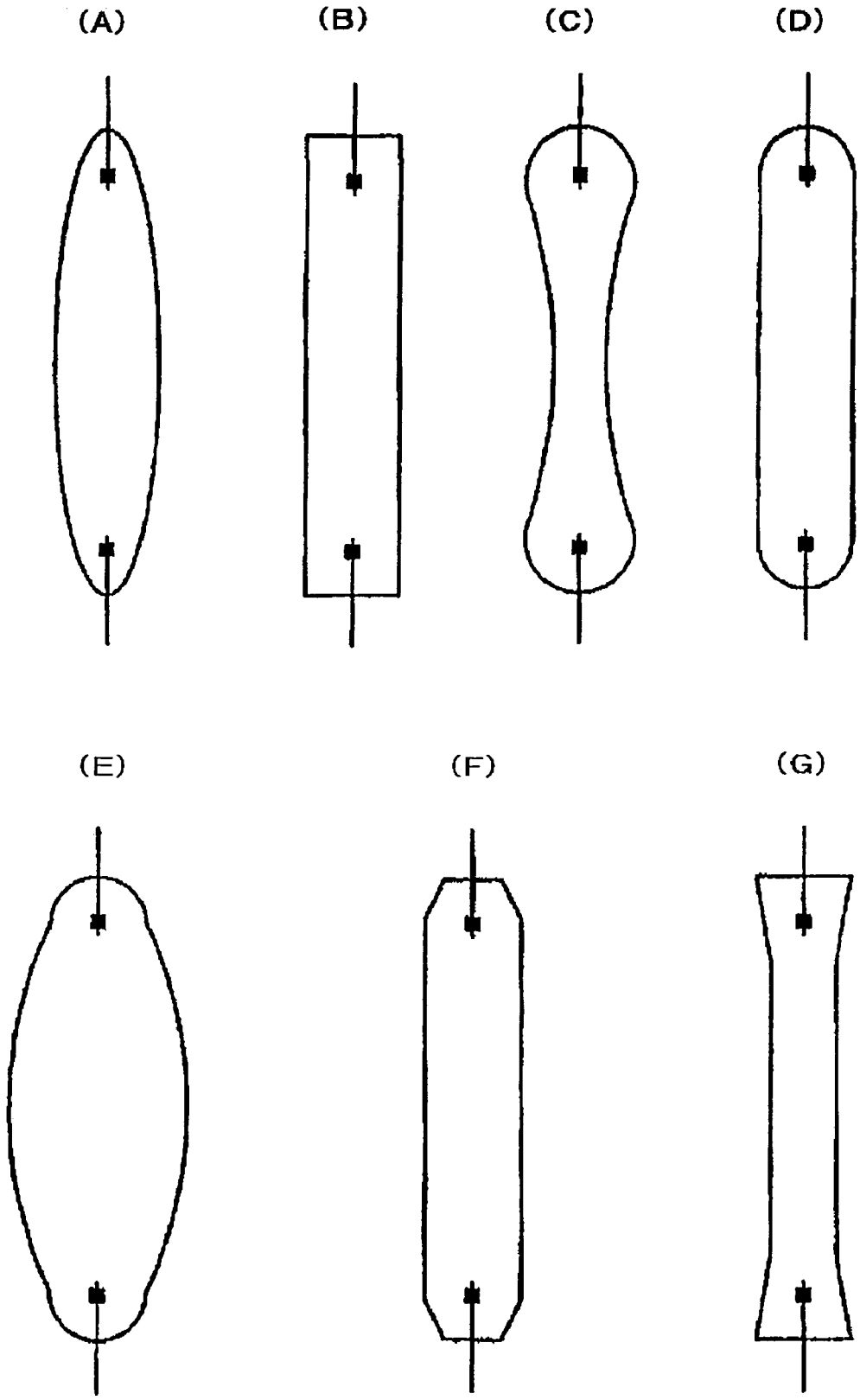
FIGS. 6(A) through (G) are diagrams each showing a cross section of an embodiment of an arc tube of the lamp of the present invention.

Hereinafter, specific examples of the metal halide lamp according to the present embodiment will be described. In each example described below, an arc tube of the shape as shown in FIG. 6(D) is used. This arc tube has a cross section of a right circular cylinder taken so that both ends of the tube wall structure appear spherical.

EXAMPLE 1

Hereinafter, a first example of the metal halide lamp according to the present invention will be described.

The basic structure of the metal halide lamp of the present example is as described with reference to FIG. 1 and FIG. 2. According to the present example, the power rating of the lamp is set at 150 W, and the interior of the outer tube 11 is retained in a decompressed state at 1 kPa. The arc tube 20 of the present example is composed of polycrystalline alumina. Within the arc tube 20, an amount of mercury (0.1 to 4.0 mg) suitable for ensuring that the lamp voltage when lit at the power rating would fall within a range from 80 to 95V, and halides for enclosure were enclosed to a total amount of 5.5 to 19 mg, according to the internal volume of the arc tube. The halides prepared were praseodymium iodide, sodium iodide, and calcium iodide at a molar ratio of 1:10:0.5, 1:10:2, or 1:10:10; that is, the molar ratio between the Ca halide amount (Hc) and the Pr halide amount (Hp) was one of the three values: Hc/Hp=0.5, 2.0, or 10. Within the arc tube 20, Xe (xenon) gas exhibiting a pressure of 200 Pa at 300K (kelvin) was further enclosed.

In the present example, lamps were prepared each of which is a metal halide lamp having the above-described structure, such that the ratio L/D of the inter-electrode distance L to the inner diameter D of the arc tube 20 was varied from 0.6 to 20. While each lamp was lit at the power rating of 150 W, the light output characteristics of the lamp were evaluated.

Figure 3:
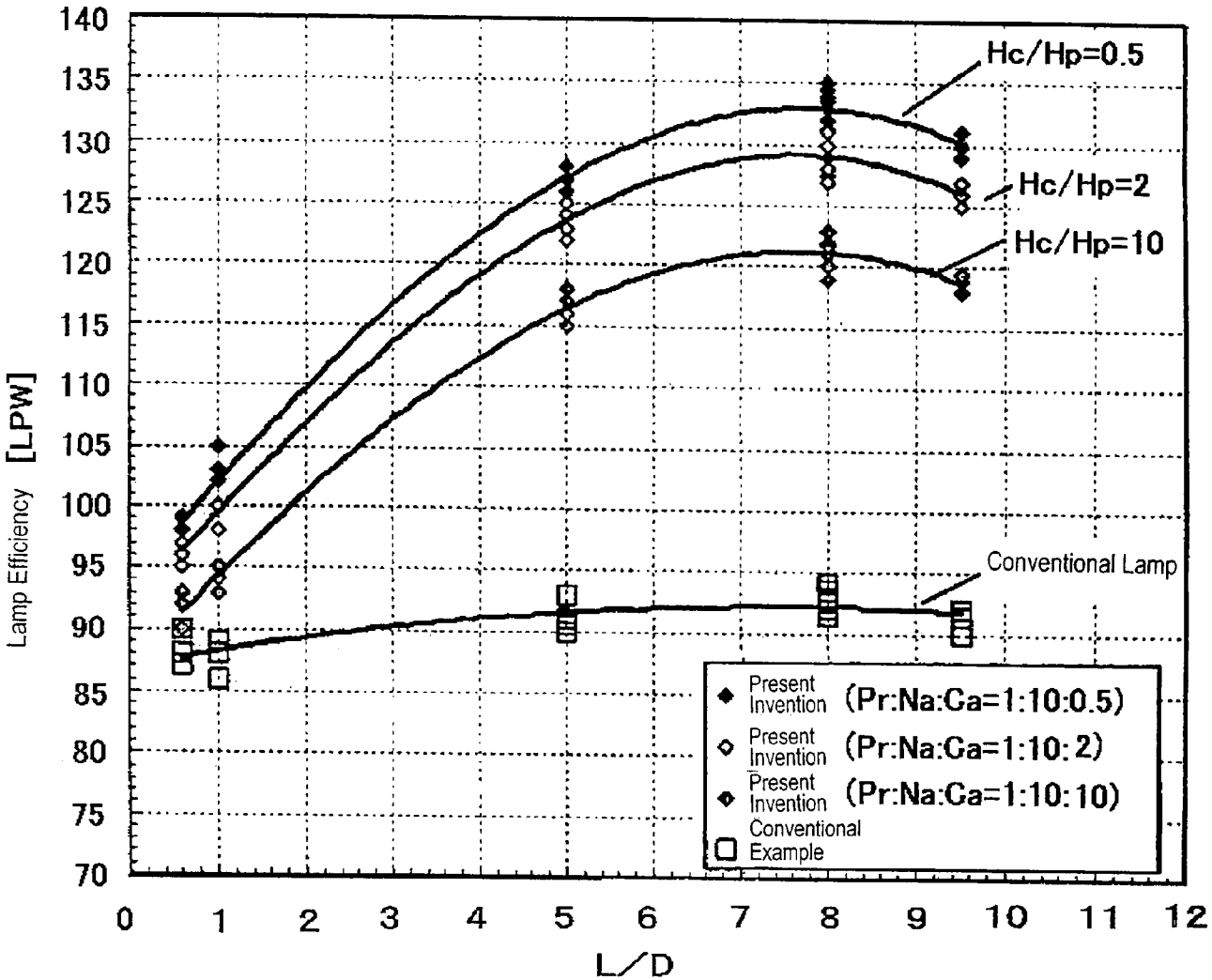
FIG. 3 is a diagram showing a relationship between lamp efficiency (LPW) and a ratio of length between arc tube electrodes to inner diameter (L/D), with respect to lamps of the present invention.

FIG. 3 shows a relationship between the lamp efficiency [LPW] and the ratio L/D, with respect to a conventional example and typical lamps of the present invention.

The only difference between the conventional high efficiency lamp (hereinafter referred to as the "conventional lamp") and the lamps of the present invention herein is the types of enclosed substances; their structures are otherwise the same. The enclosed substances in the conventional lamp were iodides of Na, Tl, Dy, Ho, Tm, and Ca, and they were used according to the first example described in Japanese National Phase PCT Laid-Open Publication No. 2000-511689. In other words, the halides were enclosed to a total amount of 5.5 to 19 mg according to the internal volume of the arc tube, so that Na accounted for 29 mol %, Tl 6.5 mol %, Ho 6.5 mol %, Tm 6.5 mol %, and Ca 45 mol %.

As shown in FIG. 3, the lamp efficiency of the conventional lamp was typically about 90 LPW, irrespective of L/D. However, with the lamps of the present invention, it was found that a high efficiency which is about 10% or more greater than conventionally can be obtained in the case where the inter-electrode distance L and the inner diameter D satisfy the relationship of L/D≧1.0. Furthermore, it was also found that an Ra of 70 to 90 is obtained while L/D falls within this range, thus indicative of very high color rendition.

In particular when the relationship of L/D≧4 is satisfied, the lamps of the present invention have a lamp efficiency of 113 LPW, thus being able to provide an efficiency which is 25% or more greater than the lamp efficiency of the conventional lamp, i.e., 90 LPW. In other words, it was found that, when L/D≧4, it is possible to obtain a high efficiency which is equal to or greater than the lamp efficiency, 110 LPW, of a high-pressure sodium lamp—which is in use as a lamp having a high lamp efficiency. Moreover, whereas the high-pressure sodium lamp has Ra values of about 20 to 30, the lamps of the present invention exhibit very good Ra values of 70 to 90, thus reconciling high efficiency with high color rendering.

Since the lamp efficiency of the lamps of the present invention is increased by 25% or more as compared to the lamp efficiency of the conventional lamp, the number of illumination lights to be used in conventional illumination design can be reduced by 25% while maintaining the emission performance. Furthermore, in the range where the relationship of L/D≧4 is satisfied, the curving of the arc discharge can be suppressed even when the arc tube 20 is lit in a horizontal posture, and the effect of preventing flicker during lighting has been confirmed.

It is even more preferable that the inter-electrode distance L and the inner diameter D satisfy the relationship of 7≦L/D≦9. In this case, the lamp efficiency of the lamps of the present invention is maximized, so that a high value of 120 LPW or more can be attained. At this time, with those of the lamps of the present invention having a higher lamp efficiency, the lamp efficiency can be improved by about 35% as compared to 90 LPW of the conventional lamp.

From the graph of FIG. 3, it can be seen that the lamp efficiency tends to decrease where the relationship of L/D>9 is satisfied. However, it can be understood that, while the inter-electrode distance L and the inner diameter D satisfy the relationship of 9<L/D≦20, the lamps of the present invention have a lamp efficiency which is higher than the lamp efficiency of the conventional lamp, i.e., 90 LPW.

When the inter-electrode distance L and the inner diameter D satisfy the relationship of L/D>20, the inter-electrode distance L must become very large, thus making it difficult to begin or maintain discharge using a usual ignition circuit, or the inner diameter D must become small, thus making it difficult to maintain discharge due to loss of electrons at the tube wall. Therefore, it is preferable that the inter-electrode distance L and the inner diameter D satisfy the relationship of L/D<20.

Although Hc/Hp is set at one of the three values of 0.5, 2.0, or 10 in the present example, it is necessary to ensure Hc/Hp≦2.0 in order to realize 100 LPW or more in the range of 1.0≦L/D≦20. However still, the lamp efficiency can be improved from that of the conventional lamp while Hc/Hp≦15.0.

Moreover, while L/D≧4, a high lamp efficiency of 100 LPW or more can be realized in the entire range of Hc/Hp≦15.

In order to obtain the effects of the present invention, it is necessary to enclose at least 1 mol % or more of a praseodymium halide, a sodium halide, and a calcium halide within the arc tube.

In order to obtain the effects of the present invention, each of the Pr halide, Na halide, and Ca halide contents is preferably set to be 1.0 mg/cm$^3$ or more, and more preferably set in the range of 2.0 to 25 mg/cm$^3$.

Light-transmissive ceramics are to be used for the arc tube material in the present example. However, in the case where a quartz arc tube is used, for example, Pr and quartz will react with each other, so that problems such as devitrification may occur at an early stage of life. The same is also true of Ca, and therefore the effects of the present invention cannot be obtained in the case where the enclosed substances according to the present example are used in conjunction with a quartz arc tube.

EXAMPLE 2

Hereinafter, a second example of the metal halide lamp according to the present invention will be described.

The lamp of the present example is different from the lamp of Example 1 as follows. Within the arc tube 20, 0.5 mg of mercury was enclosed; as halides for enclosure, praseodymium iodide and sodium iodide were enclosed at a ratio of 1:10 and to a total of 9 mg; and calcium iodide was added so that the molar ratio Hc/Hp between the Ca halide amount (Hc) and the Pr halide amount (Hp) was in the range of 0.2 to 18.

Moreover, the inner diameter D of the main tubing 25 between the two electrodes 32 was about 4 mm. The inter-electrode distance L between the two electrodes 32 in a discharge region 201 of the arc tube 20 was about 32 mm, thus providing the same value of arc length. Otherwise there was no difference from Example 1. Given the fact that the inter-electrode distance L has conventionally been about 10 mm in the case of a power rating of 150 W, the inter-electrode distance L of the lamp of the present invention is extremely long. Under a power rating of 150 to 200 W, the inter-electrode distance L of the lamp of the present invention is preferably set within the range of 20 mm to 50 mm. If the inter-electrode distance L is less than 20 mm, the inner diameter D must increase given the same tube wall load, so that the arc may curve, possibly breaking the arc tube. On the other hand, if the inter-electrode distance L exceeds 50 mm, it becomes difficult to start the lamp.

The lamp of the present invention was lit with a power rating of 150 W, and the light output characteristics of the lamp were evaluated.

Figure 4:
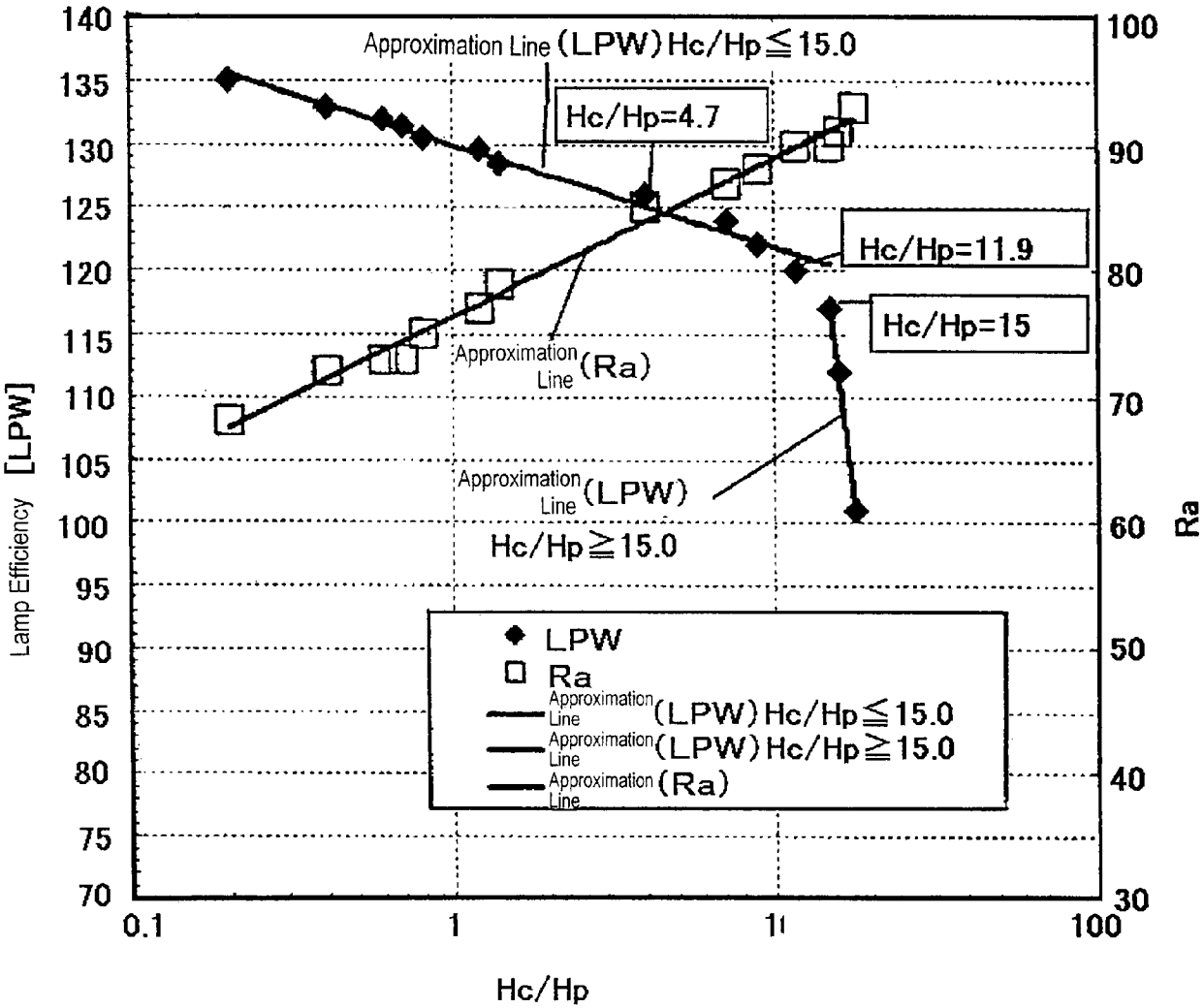
FIG. 4 is a diagram showing a relationship between lamp efficiency (LPW) and general color rendering indices (Ra) on the basis of molar ratios between Ca halide amount and Pr halide amount, with respect to the lamp of the present invention.

FIG. 4 shows, with respect to the lamp of the present invention, a relationship between the lamp efficiency [LPW] and general color rendering index Ra, relative to the molar ratio Hc/Hp between the Ca halide amount (Hc) and the Pr halide amount (Hp). As shown in FIG. 4, the efficiency decreases as the Hc/Hp ratio increases, such that the efficiency is 117 LPW when Hc/Hp=15. As the Hc/Hp ratio further increases beyond 15, the efficiency decreases drastically.

On the other hand, Ra is on a constant increase as the Hc/Hp ratio increases. When Hc/Hp=0.4, Ra is 70. In other words, in the range of $0.4 \leqq Hc/Hp \leqq 15.0$, it is possible to achieve both an efficiency (an efficiency of 115 LPW or more) which is 25% or more greater than the conventional lamp efficiency of 90 LPW, and high color rendition with an Ra of 70 or more.

A 25% improvement in efficiency is an amount which allows humans to perceive a definite improvement in brightness. A 25% increase in efficiency from the conventional lamp implies a groundbreaking efficiency.

Since the efficiency reads 125 LPW when Hc/Hp=4.7, it is indicated that an efficiency of 125 LPW, which is greater by about 40% than that of the conventional lamp, is obtained in the range of $Hc/Hp \leqq 4.7$, while maintaining high color rendition with an Ra of 70 or more.

Since the efficiency reads 120 LPW and Ra reads 90 when Hc/Hp=11.9, it follows that an efficiency (efficiency of 115 LPW or more) which is greater by about 25% or more than the efficiency (90 LPW) of the conventional lamp and very high color rendition with an Ra of 90 or more can be obtained in the range of $Hc/Hp \geqq 11.9$. Furthermore, it has also been confirmed that excellent white light, with a duv of 0.005 or less (which approximates the black body locus) is exhibited.

With the lamp of the present invention, color rendition similar to the color rendition (Ra of 90 to 92) of the conventional lamp is obtained in the range of $11.9 \leqq Hc/Hp \leqq 15.0$.

As was described with respect to Example 1, the lamp efficiency varies depending on the ratio L/D between the inter-electrode distance L and the inner diameter D. Although Example 2 prescribes L/D=8, it is possible in the range of $L/D \geqq 1.0$ to achieve a high efficiency over the conventional lamp efficiency of 90 LPW as long as $Hc/Hp \leqq 15$, as described in Example 1.

In both Examples 1 and 2, the ratio between praseodymium iodide and sodium iodide is set at 1:10. However, as long as this ratio is within the range of 1:3 to 1:25, high color rendition can be exhibited with a similarly high efficiency.

EXAMPLE 3

Hereinafter, a third example of the metal halide lamp according to the present invention will be described.

The lamps of the present example have an identical structure to the lamp structure of Example 2, except for the ratio between enclosed halides.

In the present example, the molar ratio Hc/Hp between the Ca halide amount (Hc) and the Pr halide amount (Hp) was varied in the range from 0.4 to 15.0, and the molar ratio Hn/Hp between the Na halide amount (Hn) and the Pr halide amount (Hp) was varied in the range from 3.0 to 25.0.

Figure 5:
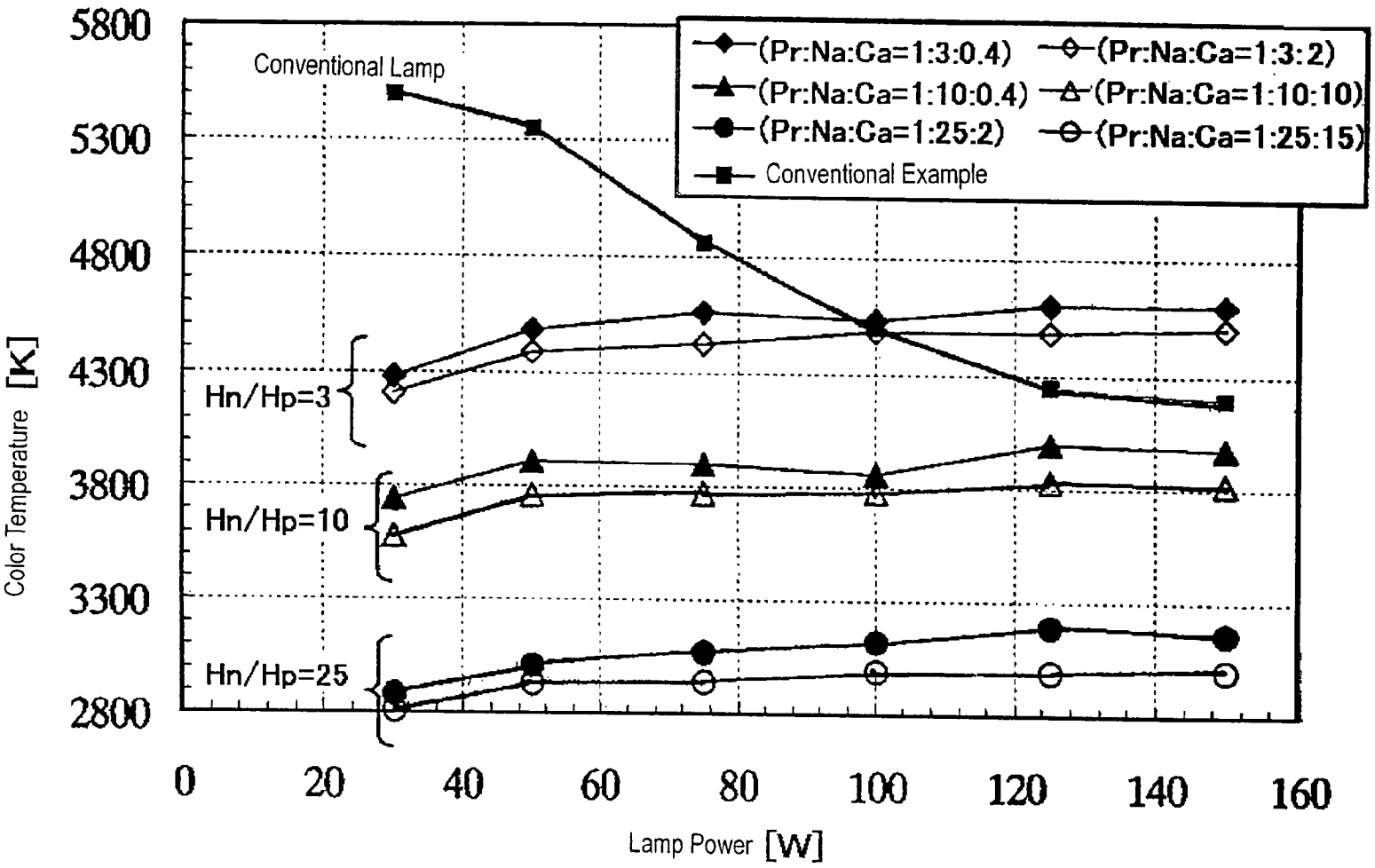
FIG. 5 is a diagram showing changes in color temperature with respect to typical lamps of the present invention, in the case where dimming is performed from 30 W to 150 W.

Among them, FIG. 5 shows a relationship between the lamp input power (W) and color temperature (K) with respect to the cases where Pr:Na:Ca was varied as follows: 1:3:0.4; 1:3:2; 1:10:0.4; 1:10:10; 1:25:2; and 1:25:15.

For comparison, FIG. 5 also shows a relationship between input power and chromaticity of a conventional lamp, with respect to a lamp (conventional lamp) which is in accordance with the lamp described in Japanese National Phase PCT Laid-Open Publication No. 2000-511689, as in Example 1.

As shown in FIG. 5, if the input power of the conventional lamp is decreased, the color temperature increases. However, with the lamps of the present invention, the change in color temperature is suppressed to be within about 300K even when the input power is reduced to 25% of the power rating, thus indicative of excellent dimming characteristics.

As shown in FIG. 5, the color temperature of the lamp is substantially determined by Hn/Hp, whereas Hc/Hp hardly affects the color temperature. Furthermore, within the embodied ranges of Hn/Hp and Hc/Hp, excellent dimming characteristics are being obtained irrespective of these ratios.

The cause for the color temperature fluctuation of the conventional lamp is the fact that the enclosed Tl and the other enclosed substances (especially, the 3A group such as Dy and Ho) exhibit different vapor pressure characteristics with a strong dependency on temperature. Therefore, with an input power below the power rating, the emission balance is lost so that Tl, which would give strong emission even in a low temperature state during dimming, exhibits a green emission color, thus boosting up the color temperature of the lamp.

On the other hand, with the lamps of the present invention, the main emission emanates from Pr and Na, so that their vapor pressure fluctuations under given temperature changes are substantially equal relative to each other. In addition, since a Ca halide is mixed, the emission balance between the enclosed substances is stabilized even against fluctuations in the ignition conditions, thus realizing dimming characteristics which would not be attained with Pr and Na alone.

Although L/D is set at 8 in the present example, similarly good dimming characteristics were obtained as long as L/D satisfied the relationship of $1.0 \leqq L/D \leqq 20$.

Figure 7:
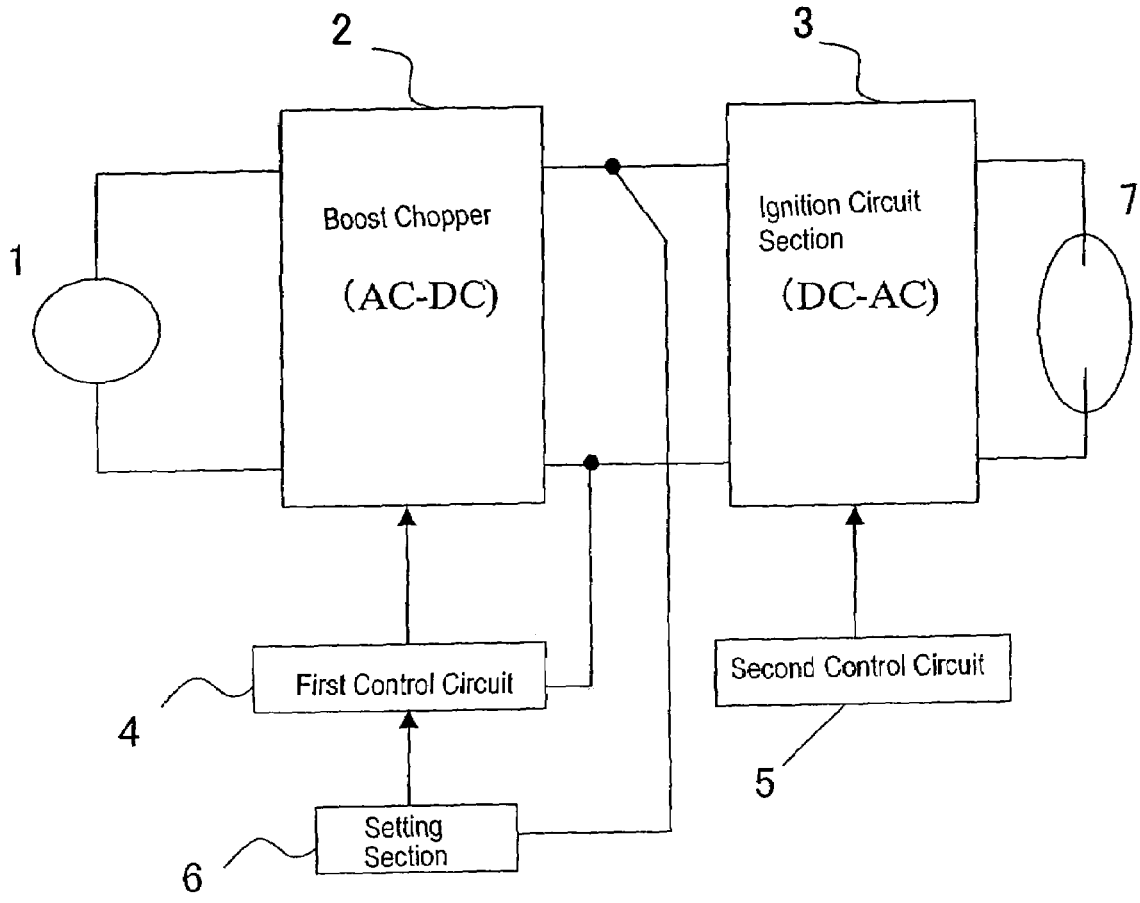
FIG. 7 is a block circuit diagram showing an exemplary configuration of a system (illumination device) comprising a metal halide lamp of the present invention and an electronic ballast.

Dimming of the metal halide lamps of the present example is preferably performed by using an electronic ballast. FIG. 7 is a block circuit diagram illustrating an exemplary configuration of a system (illumination device) comprising a metal halide lamp according to the present invention and an electronic ballast. The electronic ballast shown in FIG. 7 includes:

a boost chopper 2 which receives an AC current from a commercial power source 1 and converts it to a DC current; and an igniting circuit section 3 which converts the DC current to an AC current having a regulated frequency and waveform. The AC current which is output from the ignition circuit section 3 is supplied to a metal halide lamp 7 according to the present invention.

The electronic ballast further includes a first control circuit 4, a second control circuit 5, and a setting section 6. The first control circuit 4 performs control such that the magnitudes of a voltage and current output from the boost chopper 2 are detected by the first control circuit 4 and will take values as set by the setting section 6. The output waveform and frequency of the ignition circuit section 3 are controlled by the second control circuit 5.

Dimming of the metal halide lamp 7 is performed by the first control circuit 4 controlling the operation of the boost chopper 2 so that an output having a value as set by the setting section 6 is obtained from the boost chopper 2.

By using an electronic ballast having this structure, not only is it possible to perform stable and instantaneous dimming until the end of the metal halide lamp life, but it is also possible to reduce the influence of source voltage fluctuations even during lighting at the power rating.

With the device of FIG. 7, even if the input power to the lamp 7 is reduced to 25% of the lamp power rating, changes in color temperature are suppressed to within about 300K, and excellent dimming characteristics are obtained, as described above.

In accordance with the metal halide lamp of the present invention, as described with reference to Examples 1 to 3, the lamp voltage undergoes little increase during its life, and good lamp characteristics are obtained, with little changes occurring in the electrical characteristics until the end of life.

Moreover, it has also been confirmed with the metal halide lamp of the present invention that there is little change in the optical characteristics (especially color temperature changes) during the lifetime, and that diversifications (individual differences) in color characteristics during manufacture are also small. This is a unique effect of the present invention which is obtained by the mixed use of Pr, Na, and Ca halides, and expresses itself as stabilization of the emission balance at dimming.

Although each of Examples 1 to 3 illustrates a particularly preferable example where the interior of the outer tube 11 is set to a decompressed state of 1 kPa, the interior of the outer tube 11 may be set to a nitrogen atmosphere of, e.g., 50 kPa or less. In this case, the lamp efficiency slightly decreases, but it is still possible to provide a metal halide lamp which combines both a high efficiency and high color rendition and yet provides excellent dimming characteristics, as in the case with the lamps of the Examples. In the case where the interior of the outer tube 11 is set to a nitrogen atmosphere of 50 kPa, a decrease in efficiency of about 2 to 3 LPW occurs only in the region where the efficiency exceeds 120 LPW; therefore, it is preferable to set the interior of the outer tube 11 to a decompressed state of 1 kPa or less.

Although iodides are used for the Pr, Na, and Ca halides in the lamps of Examples 1 to 3, bromides of Pr, Na, and Ca, or, any combination of iodides and bromides of Pr, Na, and Ca may also be used. In such cases, too, a metal halide lamp which combines both a high efficiency and high color rendition and yet provides excellent dimming characteristics can be provided.

Arc Tube Configurations

As described above, the arc tube 20 may have any other geometrical shape different from the configuration as shown in FIG. 1 and FIG. 2.

FIG. 6(A) through FIG. 6(G), which are cross-sectional views taken along the longitudinal axis of the arc tube, show various exemplary configurations that may be adopted for the arc tube 20. Although the inner surface of the tube wall and the outer surface of the tube wall would constitute a surface of a body of revolution around a rotation axis which is the longitudinal axis of the arc tube, they are not of any particular importance herein and therefore are omitted from illustration.

The inner diameter D of the inner surface of any such tube wall can be calculated by obtaining the internal area of the cross-sectional view between the electrodes (i.e., across the distance L between the tips of the electrodes), and dividing this area by L. Other types of inner surfaces may require a more complicated averaging procedure for calculating the inner diameter thereof.

Hereinafter, each arc tube shape, as well as advantages obtained when each such arc tube is used, will be described. Any condition other than the arc tube shape is the same.

FIG. 6(A) shows an arc tube in which a central portion of the arc tube has an elliptical cross section.

FIG. 6(B) shows an arc tube having a cross section of a right circular cylinder taken so that both ends of a central portion of the arc tube appear flat. This arc tube shape is characterized by little change in the color temperature during lighting. Therefore, this is effective particularly in the case where changes in the emission color are a problem.

FIG. 6(C) shows an arc tube which has a cross section such that both ends of a central portion of the arc tube appear spherical and side faces of the central portion of the arc tube appear recessed.

FIG. 6(D) shows an arc tube having a cross section of a right circular cylinder taken so that both ends of a central portion of the arc tube appear spherical.

FIG. 6(E) shows an arc tube which has a cross section such that both ends of a central portion of the arc tube appear spherical and side faces of the central portion of the arc tube appear elliptical.

FIG. 6(F) is the shape employed in Examples 1 and 2.

FIG. 6(G) shows an arc tube having a cross section of a right circular cylinder taken so that both ends of a central portion of the arc tube have a large diameter and appear flat.

The arc tubes of FIG. 6(A) and FIG. 6(E) are characterized in that individual diversifications in color temperature are particularly small when mass-produced. Therefore, these arc tube shapes are particularly preferable in the case where they are to be used in large quantity for ceiling illuminations or the like so that color temperature diversifications might stand out.

The arc tubes of FIG. 6(C) and FIG. 6(G) are characterized in that they are quick in light excitation at the start. The time required for reaching the light output rating can be reduced by about 10 to 20%, although depending on the particular design. Moreover, the arc curving when lit in a horizontal posture is particularly small, so that a lamp whose flicker during lighting is particularly small can be obtained.

The arc tubes of FIG. 6(D) and FIG. 6(F) can provide a lamp whose change in color temperature during lighting is the least of all.

The arc tube of FIG. 6(B) is characterized by its simple structure, which allows for a low production cost.

Many other structures are possible. Each structure may be considered as a desirable configuration for a different reason.

Thus, each structure has its advantages and disadvantages. In other words, when one pays attention to a particular active material and other lamp characteristics, a particular arc tube structure among many other structures would appear to have more advantages than the others. With any of the arc tube structures shown in FIG. 6(A) through FIG. 6(F), an arc discharge metal halide lamp having a higher lamp efficiency than conventionally can be obtained by employing the ionizable materials according to the present invention, which are to be provided in the discharge region, in the case where the inter-electrode distance L and the diameter D satisfy the above relationship (i.e., $L/D \geqq 1.0$).

Although Examples 1, 2, and 3 only illustrate results obtained when mercury is enclosed within the arc tube 20, the effects of the present invention can similarly be obtained in the absence of mercury.

Although Examples 1, 2, and 3 above are directed to lamps whose power rating is 150 W, the power rating of the metal halide lamp of the present invention is not limited to 150 W. As the power rating increases, the proportion of loss power (such as electrode loss) relative to the overall power consumption decreases, so that the lamp emission efficiency will be increased. On the other hand, if the power rating is decreased, the proportion of loss power increases, so that the emission efficiency will be reduced. Therefore, the emission efficiency described in the present examples only exemplifies values with respect to lamps whose power rating is about 150 W, and may result in a different value depending on the lamp's power rating, although that is not to say that the above effects are affected. A lamp having an improved emission efficiency relative to that of the conventional lamp can be obtained.

Thus, according to the present invention, there is realized a metal halide lamp which reconciles a higher-than-conventional lamp efficiency with high color rendition. Furthermore, one excellent effect of the mixing of a calcium halide and a praseodymium halide is that the metal halide lamp of the present invention is of a design which is less susceptible to fluctuations in the coldest point temperature, which is advantageous in terms of color stability at dimming.

INDUSTRIAL APPLICABILITY

The metal halide lamp of the present invention is excellent in both efficiency and color rendition. Moreover, there is little characteristics diversification during manufacture and little characteristics change during lifetime, and a wide range of dimming is possible. Therefore, the metal halide lamp of the present invention is effective for outdoor illuminations such as streetlight illuminations and for indoor illuminations such as high-ceiling illuminations, and may also be suitably used for store illuminations.

The invention claimed is:

1. A metal halide lamp having an arc tube formed of ceramic and a pair of opposing electrodes, comprising:

a Pr (praseodymium) halide, a Na (sodium) halide, and a Ca (calcium) halide enclosed within the arc tube, wherein the Pr halide content Hp [mol], the Na halide content Hn [mol], and the Ca halide content Hc [mol] satisfy the relationships of:

$$0.4 \leqq Hc/Hp \leqq 15.0; \text{ and}$$

$$3.0 \leqq Hn/Hp \leqq 25.0.$$

2. The metal halide lamp of claim 1, wherein each of the Pr halide content, the Na halide content, and the Ca halide content is equal to or greater than 1.0 $mg/cm^3$.

3. An illumination device comprising:

the metal halide lamp of claim 2; and means for performing dimming of the metal halide lamp.

4. The metal halide lamp of claim 1, wherein $0.4 \leqq Hc/Hp \leqq 4.7$.

5. An illumination device comprising:

the metal halide lamp of claim 4; and means for performing dimming of the metal halide lamp.

6. The metal halide lamp of claim 1, wherein $11.9 \leqq Hc/Hp \leqq 15$.

7. An illumination device comprising:

the metal halide lamp of claim 6; and means for performing dimming of the metal halide lamp.

8. The metal halide lamp of claim 1, wherein an inner diameter D(mm) of the arc tube and a distance L(mm) between tips of the electrodes satisfy the relationship $4 \leqq L/D \leqq 9$.

9. An illumination device comprising:

the metal halide lamp of claim 8; and means for performing dimming of the metal halide lamp.

10. The metal halide lamp of claim 1, comprising an outer tube for accommodating the arc tube, wherein an interspace between the arc tube and the outer tube is retained in a decompressed state at 1 kPa or less.

11. An illumination device comprising:

the metal halide lamp of claim 10; and means for performing dimming of the metal halide lamp.

12. The metal halide lamp of claim 1 having a general color rendering index Ra of 70 or more, and a lamp efficiency of 100 LPW or more.

13. An illumination device comprising:

the metal halide lamp of claim 12; and means for performing dimming of the metal halide lamp.

14. An illumination device comprising:

the metal halide lamp of claim 1; and means for performing dimming of the metal halide lamp.

15. The illumination device of claim 14, wherein, the means includes an electronic ballast for supplying power to the electrodes of the metal halide lamp, and the electronic ballast is capable of regulating the power within a range from 25% of a rating to the rating.

* * * * *